US009452902B2

(12) United States Patent
Koga et al.

(10) Patent No.: US 9,452,902 B2
(45) Date of Patent: Sep. 27, 2016

(54) SHEET FEEDING APPARATUS AND IMAGE FORMING APPARATUS

(71) Applicant: CANON KABUSHIKI KAISHA, Tokyo (JP)

(72) Inventors: Hiroto Koga, Abiko (JP); Koki Sato, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/719,755

(22) Filed: May 22, 2015

(65) Prior Publication Data

US 2015/0344244 A1 Dec. 3, 2015

(30) Foreign Application Priority Data

May 29, 2014 (JP) ..... 2014-111489
May 20, 2015 (JP) ..... 2015-102922

(51) Int. Cl.

| | |
|---|---|
| ***B65H 1/04*** | (2006.01) |
| ***B65H 11/00*** | (2006.01) |
| ***B65H 1/00*** | (2006.01) |
| ***G03G 15/00*** | (2006.01) |

(52) U.S. Cl.

CPC *B65H 1/04* (2013.01); *B65H 1/00* (2013.01); *G03G 15/00* (2013.01); *B65H 2405/114* (2013.01); *B65H 2405/324* (2013.01); *B65H 2407/21* (2013.01); *B65H 2511/12* (2013.01); *B65H 2511/22* (2013.01)

(58) Field of Classification Search

CPC ..... B65H 1/04; B65H 1/266; B65H 3/44; B65H 2405/324; B65H 2511/12; B65H 1/00; G03G 15/6514

See application file for complete search history.

(56) References Cited

U.S. PATENT DOCUMENTS

| | | | | |
|---|---|---|---|---|
| 5,091,754 | A | 2/1992 | Abe et al. | |
| 5,154,411 | A | 10/1992 | Saito et al. | |
| 5,172,138 | A | 12/1992 | Okazawa et al. | |
| 5,481,336 | A | 1/1996 | Tachibana et al. | |
| 6,487,379 | B2 | 11/2002 | Sato | |
| 6,581,922 | B2 | 6/2003 | Kuwata et al. | |
| 6,955,348 | B2 | 10/2005 | Koga | |
| 7,429,041 | B2 * | 9/2008 | Yokoi | B65H 1/04 271/145 |
| 8,246,039 | B2 | 8/2012 | Koga et al. | |
| 8,511,674 | B2 | 8/2013 | Koga | |
| 2005/0067757 | A1 | 3/2005 | Suga et al. | |
| 2013/0032989 | A1 * | 2/2013 | Okuchi | B65H 1/04 271/3.14 |

FOREIGN PATENT DOCUMENTS

| | | | |
|---|---|---|---|
| JP | 09-30658 | A | 2/1997 |
| JP | 2008-120495 | A | 5/2008 |

* cited by examiner

*Primary Examiner* — Luis A Gonzalez

(74) *Attorney, Agent, or Firm* — Fitzpatrick, Cella, Harper & Scinto

(57) ABSTRACT

A sheet feeding apparatus includes an apparatus body, a manual feed tray, first and second regulating members regulating a width direction of a sheet, a feed portion feeding the sheet stacked on the manual feed tray, and a guide portion. The guide portion is provided at least at one of the apparatus body side and the first regulating member side and has an inclined surface that abuts against another member of the apparatus body and the first regulating member to guide the first regulating member in a direction separating widthwise from the second regulating member when the manual feed tray is moved from a sheet stacking position to a storage position.

23 Claims, 10 Drawing Sheets

SHEET FEEDING APPARATUS AND IMAGE FORMING APPARATUS

BACKGROUND OF THE INVENTION

1. Field of the Invention

The present invention relates to a sheet feeding apparatus and an image forming apparatus.

2. Description of the Related Art

Today, an image forming apparatus, i.e., a printer and a copier, configured to form an image on a sheet of paper (referred to simply as a 'sheet' hereinafter) supplied from a sheet feeding apparatus to an image forming portion spreads widely. Such image forming apparatus is demanded to be able to feed various kinds of sheets such as small size sheets, e.g., a postcard and an envelope, and sheets having various surface natures, e.g., a coated paper and an embossed paper, from the sheet feeding apparatus. Then, the image forming apparatus is arranged to stack these various kinds of sheets on a manual feed tray and to feed these sheets to an image forming portion by using the sheet feeding apparatus (referred to simply as a 'manual feeding apparatus' hereinafter) feeding a sheet stacked on the manual feed tray to the image forming portion by using a feed roller. It is noted that the manual feed tray is provided openably on a side surface of an image forming apparatus body and is attached inside of a cover (door) forming a sheath of the image forming apparatus body. When this manual feed tray is not in use, it is stored within the image forming apparatus body following a closing operation of the cover.

As such manual feeding apparatus, there is one configured as disclosed in Japanese Patent Application Laid-open No. Hei. 09-30658 for example. In order to downsize the image forming apparatus body (referred to simply as an 'apparatus body' hereinafter), this manual feeding apparatus is configured such that the feed roller projects out of the side surface of the apparatus body when the cover on the side surface is opened and is stored within the apparatus body when the cover is closed by being pushed by the manual feed tray.

The manual feed tray is provided with side end regulating members regulating widthwise positions orthogonal to a sheet feeding direction of a sheet to be fed. This side end regulating members are provided to adjust the widthwise positions of the sheet with an image to be formed in the image forming portion and to prevent a skew of the sheet when the sheet is delivered from the manual feed tray. The side end regulating members are also provided movably in the width direction orthogonal to the sheet feeding direction in order to be able to regulate the positions of the sheet by abutting with side edges of the sheet even if it is a sheet of different size.

By the way, the feed roller and the manual feed tray of such manual feeding apparatus are stored within the apparatus body when no sheet is fed from the manual feed tray as described above. However, if the side end regulating members are located at a position regulating a smallest size sheet at this time for example, there is a case when the side end regulating members abut against a roller holder holding the feed roller, thus disabling to close the manual feed tray.

Then, it is necessary to assure a space between the roller holder and the side regulating member in a cover opening/closing direction so that the roller holder does not abut against the side regulating members located at the position for regulating the smallest sheet in the state in which the cover is closed. However, if this space is tried to be assured, the apparatus body is enlarged. Because the arrangement of storing the feed roller within the apparatus body by pushing the feed roller by the manual feed tray when the cover is closed is made to downsize the apparatus body in particular, this arrangement poses a problem that it cannot meet the original need.

It is noted that because the feed roller needs a certain width (widthwise length) in order to stably deliver the sheet without a skew, it is difficult to reduce a widthwise length of the roller holder.

SUMMARY OF THE INVENTION

A sheet feeding apparatus of the invention includes an apparatus body, a sheet storing portion supported by the apparatus body turnably in a vertical direction and movable to a storage position in which the sheet storing portion is stored within the apparatus body and to a sheet stacking position in which a sheet is stacked, a first regulating member provided in the sheet storing portion and movable in a width direction orthogonal to a sheet feeding direction, a second regulating member provided in the sheet storing portion to face the first regulating member widthwise and regulating widthwise side end positions of the sheet stacked on the sheet storing portion together with the first regulating member, a feed portion provided in the apparatus body and feeding the sheet stacked on the sheet storing portion that has been moved to the sheet stacking position, and a guide portion provided at least on one of the apparatus body and the first regulating member and having an inclined surface that abuts against another member of the apparatus body and the first regulating member to guide the first regulating member in a direction separating widthwise from the second regulating member when the sheet storing portion moves from the sheet stacking position to the storage position.

Further features of the present invention will become apparent from the following description of exemplary embodiments with reference to the attached drawings.

DESCRIPTION OF THE EMBODIMENTS

Figure 1:
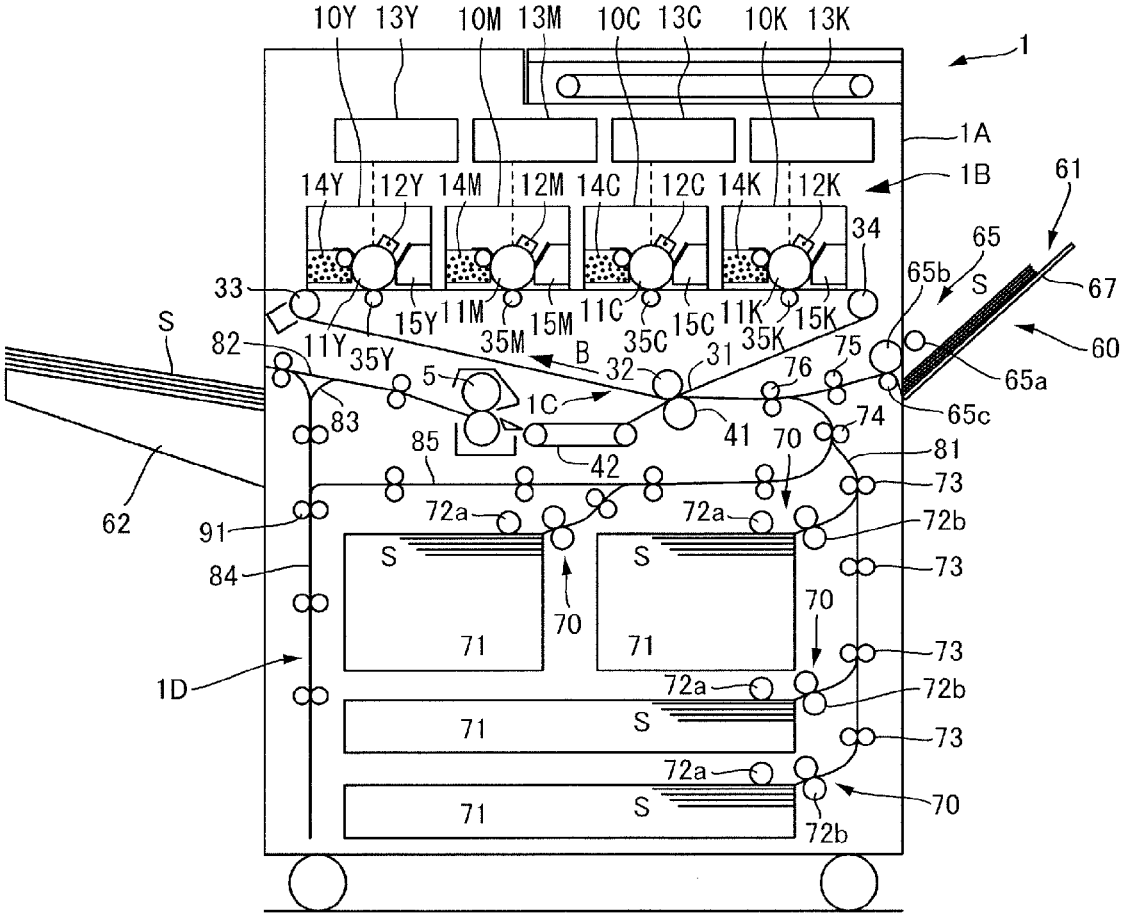
FIG. 1 is a schematic diagram illustrating a configuration of a color laser printer which is one exemplary image forming apparatus including a sheet feeding apparatus of an embodiment of the present invention.

A mode for carrying out the invention will be described in detail with reference to the drawings. FIG. 1 is a schematic diagram illustrating a configuration of a color laser printer which is one exemplary image forming apparatus including a sheet feeding apparatus of an embodiment of the invention. In FIG. 1, the color laser printer includes a color laser printer body (referred to simply as a 'printer body' hereinafter) 1A, i.e., an image forming apparatus body. Provided within the printer body 1A are an image forming portion 1B forming an image on a sheet S, an intermediate transfer portion 1C, a fixing apparatus 5, a re-conveying portion 1D, a body sheet feeding apparatus 70 feeding the sheet S to the image forming portion 1B, a manual feeding apparatus 60, and others. It is noted that in the present embodiment, a front side of a sheet surface of FIG. 1 will be expressed as a front side of the printer body 1A and a rear side the sheet surface of FIG. 1 will be expressed as a rear side of the printer body 1A.

The image forming portion 1B is disposed substantially horizontally and includes four process stations 10Y, 10M, 10Y, and 10K respectively forming toner images of four colors of yellow (Y), magenta (M), cyan (C), and black (Bk). For instance, the yellow process station 10Y includes a photosensitive drum 11Y, a charger 12Y, a developing apparatus 14Y, and a cleaner 15Y. The photosensitive drum 11Y is an image carrier carrying the yellow toner image and driven by a stepping motor not shown. The charger 12Y homogeneously electrifies the surface of the photosensitive drum 11Y. The developing apparatus 14Y applies the yellow toner to the electrostatic latent image formed on the surface of the photosensitive drum 11Y to develop as a toner image. The cleaner 15Y recovers transfer residual toner left on the surface of the photosensitive drum 11Y. The charger 12Y, the developing apparatus 14Y, and the cleaner 15Y are disposed around the photosensitive drum 11Y along a rotation direction thereof. It is noted that because the other three process stations 10M, 10C, and 10K have the same configuration with that of the process station 10Y except that the colors of the respective toners are different, they will be denoted by the signs of the respective colors (M, C, and K) and their detailed explanation will be omitted here.

The image forming portion 1B also includes scanners 13Y, 13M, 13C, and 13K irradiating laser beams based on image information and forming the electrostatic latent images on the surface of the respective photosensitive drums 11Y, 11M, 11C, and 11K rotating at a constant speed.

The body sheet feeding apparatus 70 includes a sheet feed cassette 71 provided at a lower part of the printer body 1A and storing the sheet S, a pickup roller 72*a* delivering the sheet S stacked and stored in the sheet feed cassette 71, and a separating roller pair 72*b*. The body sheet feeding apparatus 70 is configured to be able to feed the sheet S stored in the sheet feed cassette 71 toward the image forming portion 1B by rotating the pickup roller 72*a*.

The manual feeding apparatus (sheet feeding apparatus) 60 is disposed on a side of the printer body 1A and includes a manual feed tray 61, i.e., a sheet storing portion, for stacking the sheet S manually fed and a feed portion 65 for delivering the sheet S stacked on the manual feed tray 61. The manual feeding apparatus 60 also includes a manual feeding apparatus body (apparatus body) 60*a*. In the present embodiment, the manual feeding apparatus body 60*a* is composed of a part of the side portion of the printer body 1A. The manual feeding apparatus 60 is configured to be able to feed the sheet S stacked on the manual feed tray 61 to the image forming portion 1B by operating the sheet feeding portion 65.

The intermediate transfer portion 1C includes the intermediate transfer belt 31 rotationally driven along an array direction of the respective process stations 10Y, 10M, 10C, and 10K indicated by an arrow B in synchronism with an outer peripheral speed of the respective photosensitive drums 11Y, 11M, 11C, and 11K. The intermediate transfer belt 31 is stretched around a driving roller 34, a driven roller 32 forming a secondary transfer area by nipping the intermediate transfer belt 31, and a tension roller 33 which applies adequate tension to the intermediate transfer belt 31 by a bias force of a spring not shown. Disposed within an inner circumferential side of the intermediate transfer belt 31 are primary transfer rollers 35Y, 35M, 35C, and 35K. The primary transfer rollers 35Y, 35M, 35C, and 35K respectively form primary transfer portions by nipping the intermediate transfer belt 31 together with the photosensitive drums 11Y, 11M, 11C, and 11K. Then, the primary transfer rollers 35Y, 35M, 35C, and 35K apply transfer bias to the intermediate transfer belt 31. Thereby, the respective color toner images on the surfaces of the photosensitive drums 11Y, 11M, 11C, and 11K are sequentially superimposed and transferred onto the intermediate transfer belt 31, and a full-color image is formed on the intermediate transfer belt 31.

Still further, a secondary transfer roller 41 is disposed so as to face the driven roller 32. The secondary transfer roller 41 is in contact with a lowest surface of the intermediate transfer belt 31 and also nips and conveys a sheet S, conveyed from a registration roller 76, together with the intermediate transfer belt 31. Then, when the sheet S passes through a nip portion between the secondary transfer roller 41 and the intermediate transfer belt 31, a bias is applied to the secondary transfer roller 41 and the toner images on the intermediate transfer belt 31 are secondarily transferred onto the sheet S.

Next, an image forming operation of the color laser printer 1 constructed as described above will be described. When the image forming operation is started, latent images are formed respectively on the photosensitive drums 11Y and others in the process stations 10Y and others disposed respectively along the intermediate transfer belt 31. After that, the latent images are developed respectively by the developing apparatus 14Y and others to form the toner images. Next, the toner images formed thus respectively on the surfaces of the photosensitive drums 11Y and others are sequentially and primarily transferred onto the intermediate transfer belt 31 in the primary transfer area. As a result, the four color toner images are primarily transferred onto the intermediate transfer belt 31 and the full-color image is formed on the intermediate transfer belt 31. It is noted that transfer residual toner slightly left on the surface of the photosensitive drums 11Y and others is recovered by the cleaners 15Y and others to be ready for the next image forming operation.

In parallel with this toner image forming operation, the sheet S stored in the sheet feed cassette 71 is separated and fed one by one by the pickup roller 72*a* and the separating roller pair 72*b* of the body sheet feeding apparatus 70. The sheet S fed from the sheet feed cassette 71 is conveyed to the registration roller 76 by conveying rollers 73 and 74. In a case of a manual feeding operation, a sheet S set on the manual feed tray 61 by a user is sent to the sheet feeding portion 65 of the manual feeding apparatus 60 and is conveyed to the registration roller 76 by a drawing roller 75. Here, the registration roller 76 has a function of leveling a front end of the sheet S and of correcting a skew by causing the sheet S to hit against the registration roller 76 and to form a loop. Thus, a skew of the conveyed sheet S is corrected by the registration roller 76.

After correcting the skew, the registration roller 76 starts to rotate at a timing by which the front end of the sheet is synchronized with the toner image formed on the intermediate transfer belt 31, and the sheet S is conveyed to the nip portion between the secondary transfer roller 41 and the intermediate transfer belt 31. Then, the sheet S is conveyed while being nipped by the secondary transfer roller 41 and the intermediate transfer belt 31. When the sheet S passes through the nip portion between the secondary transfer roller 41 and the intermediate transfer belt 31, the toner images on the intermediate transfer belt 31 is secondarily transferred to the sheet S by the bias applied to the secondary transfer roller 41.

Next, the sheet S on which the toner image has been secondarily transferred is conveyed to the fixing apparatus 5 by a pre-fixing conveying apparatus 42. The fixing apparatus 5 fixes the toner image formed on the sheet S through the intermediate transfer belt 31. That is, the sheet S holding the toner image receives heat and pressure when it passes through the fixing apparatus 5 so that the toner image is fixed on the sheet S. A selection of a route is made here to convey the sheet S having the image thus fixed to a discharge conveying path 82 in a case when the sheet S is discharged on a gear train 62 as it is or to a reverse guide path 83 of the re-conveying portion 1D in a case when images are formed on both sides of the sheet S.

It is noted that in the case when images are formed on both surfaces of the sheet S for example, the sheet S is drawn from the reverse guide path 83 to a switchback path 84 in the re-conveying portion 1D. Thereby, front and rear ends of the sheet S are switched by a switchback operation performed by reversing a rotation direction of a reverse roller pair 91 and the sheet S is conveyed to a duplex conveying path 85. Subsequently, the reversed sheet S is conveyed again to the registration roller 76 in association with a sheet S of a succeeding job fed by the body sheet feeding apparatus 70 and is sent to the secondary transfer portion through the registration roller 76. It is noted that the subsequent image forming process performed on the back surface (second surface) of the sheet S is the same with the case of the surface (first surface) of the sheet S described above.

Here, a right cover (cover) 67 supported openably by a spindle 67*b* provided horizontally in a front-back direction in the manual feeding apparatus body 60*a* (printer body 1A) is provided on a right side part of the printer body 1A. The manual feeding apparatus 60 is provided from an upper side portion (inner side portion) of the right cover 67 to an inside of the manual feeding apparatus body 60*a*. That is, the manual feed tray 61 is provided on the upper side portion of the right cover 67, and the sheet feeding portion 65 is provided within the manual feeding apparatus body 60*a* and in a vicinity of the spindle 67*b* of the right cover 67. Still further, the manual feed tray 61 is movable between a storage position where the manual feed tray 61 is stored within the manual feeding apparatus body 60*a* (see FIG. 5) and a sheet stacking position (see FIG. 2) where the sheet S is stacked.

Figure 2:
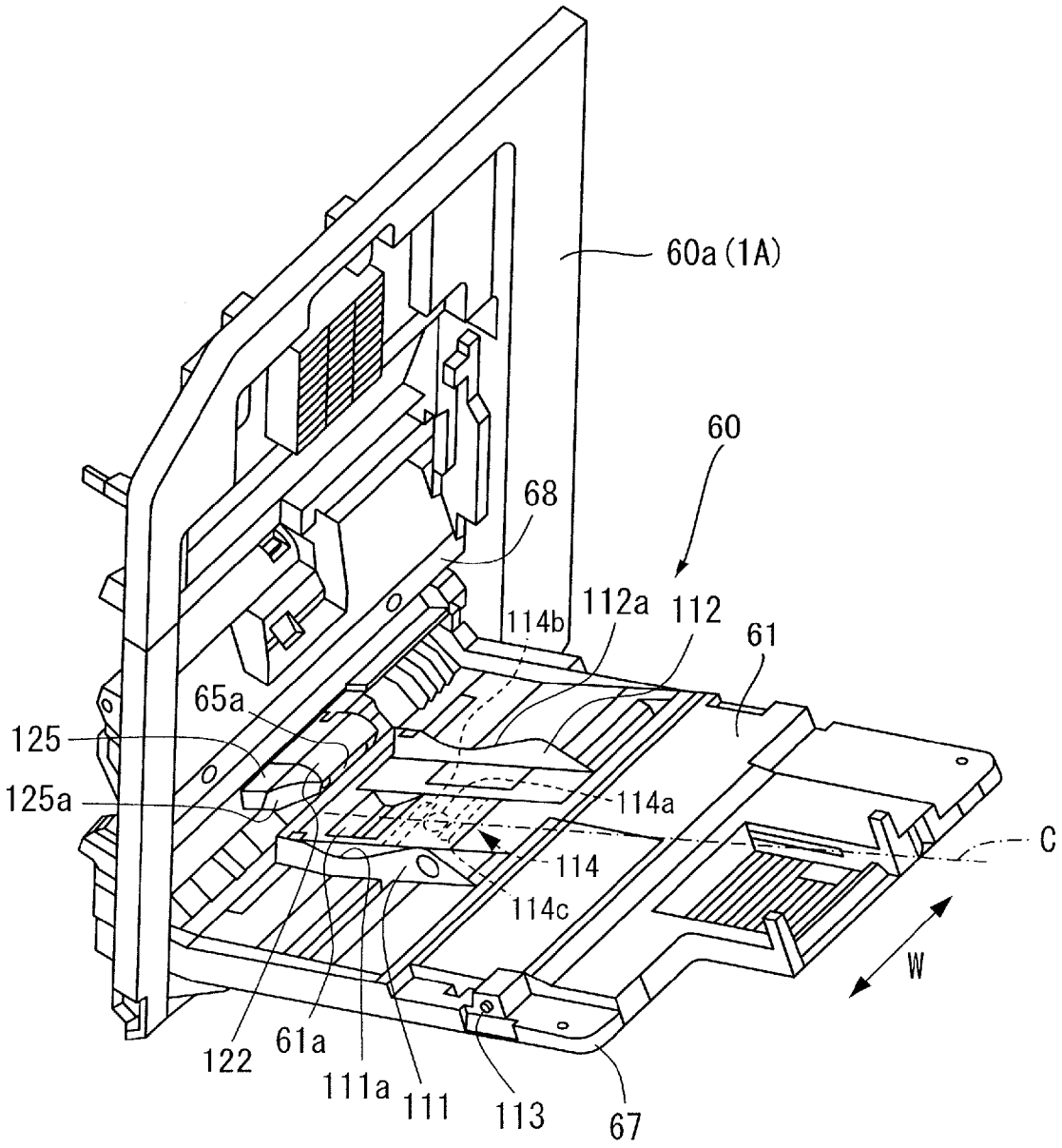
FIG. 2 is a perspective view showing a configuration of a manual feeding apparatus as the sheet feeding apparatus.

The manual feeding apparatus 60 is configured to be able to feed sheets of many sizes from a postcard-size sheet to an A3-size sheet and many types of sheets such as an envelope and a postcard. Then, in order to be able to stably feed those various kinds of sheets, the manual feed tray 61 is provided with a pair of regulating members 111 and 112 regulating end positions in a widthwise direction W orthogonal to a sheet feeding direction of the sheet stacked as shown in FIG. 2 movably in the width direction W. In the present embodiment, the pair of regulating members 111 and 112 is a first regulating member 111 disposed on the front side of the printer body 1A and a second regulating member 112 disposed on the rear side of the printer body 1A.

The manual feeding apparatus 60 includes an interlock mechanism 114 that interlocks the first and second regulating members 111 and 112 such that they move in opposite directions widthwise W from each other. The interlock mechanism 114 includes a pinion gear 114*a* provided rotably at a widthwise center part of the manual feed tray 61 and racks 114*b* and 114*c* engaging with the pinion gear 114*a*. The racks 114*b* and 114*c* extend respectively in the width direction W. The rack 114*b* is connected with the first regulating member 111 and the rack 114*c* is connected with the second regulating member 112. Thus, the regulating members 111 and 112 are interlocked by the interlock mechanism 114, i.e., a rack and pinion mechanism composed of these racks 114*b* and 114*c* and the pinion gear 114*a*, and can be moved in the width direction W to positions corresponding to sheet size. It is noted that in FIG. 2, the manual feed tray 61 is provided openably from the manual feeding apparatus body 60*a* by means of the right cover 67. The manual feed tray 61 is also provided, between the regulating members 111 and 112 of an upper surface thereof, with a concave portion 61*a* to which a pickup roller 65*a* enters when the manual feed tray 61 is stored. It is noted that the interlocking mechanism may be a mechanism interlocking the regulating members 111 and 112 by means of a belt other than the rack and pinion mechanism.

Figure 3A:
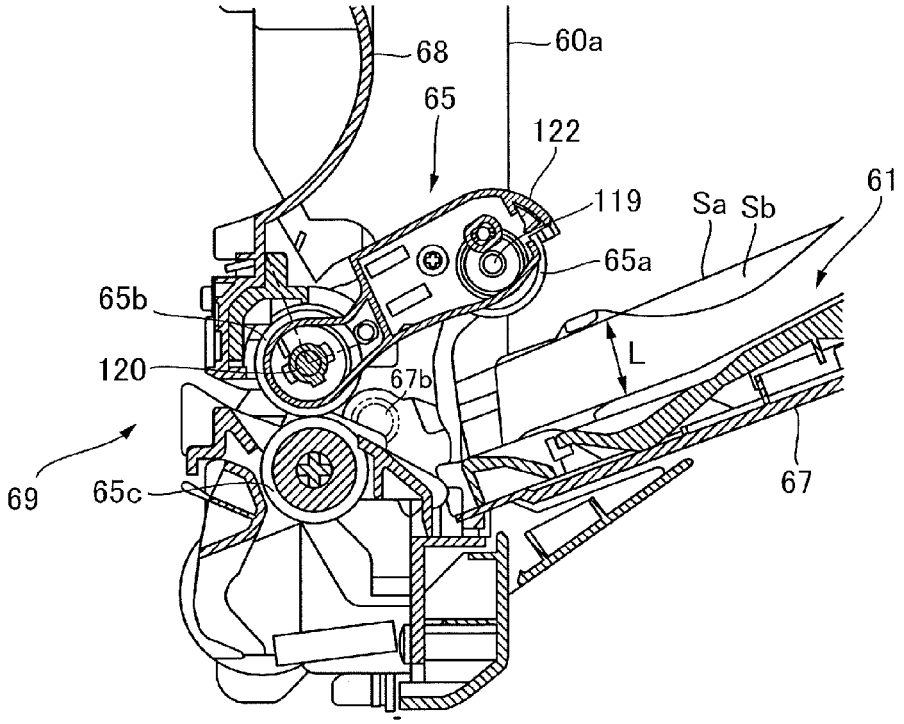
FIG. 3A illustrates a state in which a pickup arm of a sheet feeding portion provided in the manual feeding apparatus is located at a standby position.
Figure 3B:
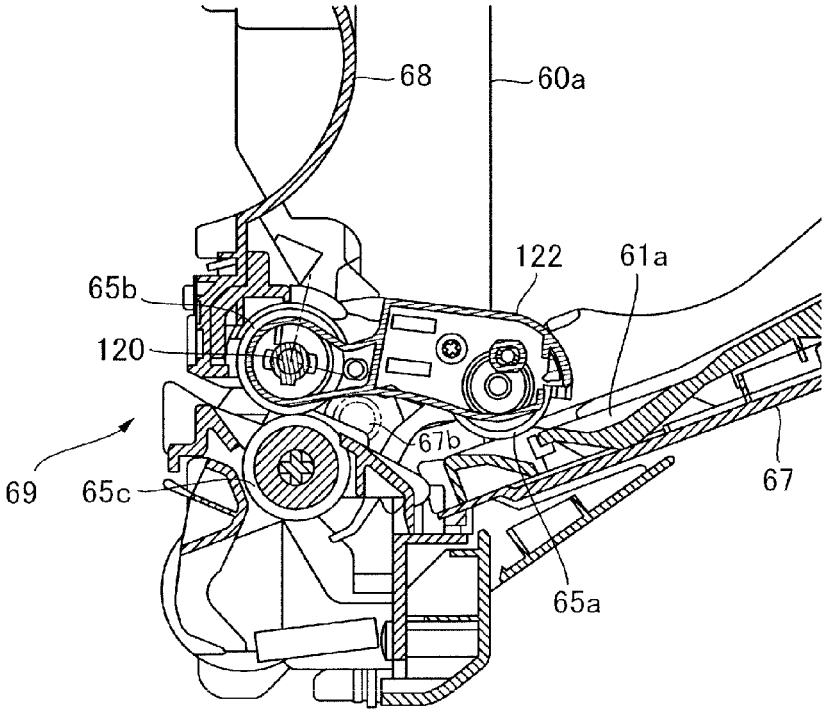
FIG. 3B illustrates a state in which the pickup arm is located at a lowest position.

As shown in FIGS. 3A and 3B, the sheet feed portion 65 of the manual feeding apparatus 60 includes the pickup roller 65*a*, i.e., a feed roller, a pickup arm 121 and a separating portion 69 composed of a feed roller 65*b* and a retard roller 65*c*. The feed roller 65*b* is connected with a feed roller shaft 120 and rotates in a body with the feed roller shaft 120. The feed roller shaft 120 rotates as rotation is transmitted from a driving portion 64 shown in FIGS. 4A and 4B and described later. Therefore, the feed roller 65*b* is rotated by the rotation transmitted from the driving portion 64 through the feed roller shaft 120. A driving force rotating in a direction opposite to a direction in which the sheet S is fed is transmitted to the retard roller 65*c* from a driving source such as a motor through a torque limiter not shown. It is noted that the retard roller 65*c* may be also arranged such that no driving force is transmitted and may be attached to the manual feeding apparatus 60 rotably through the torque limiter.

Figure 4A:
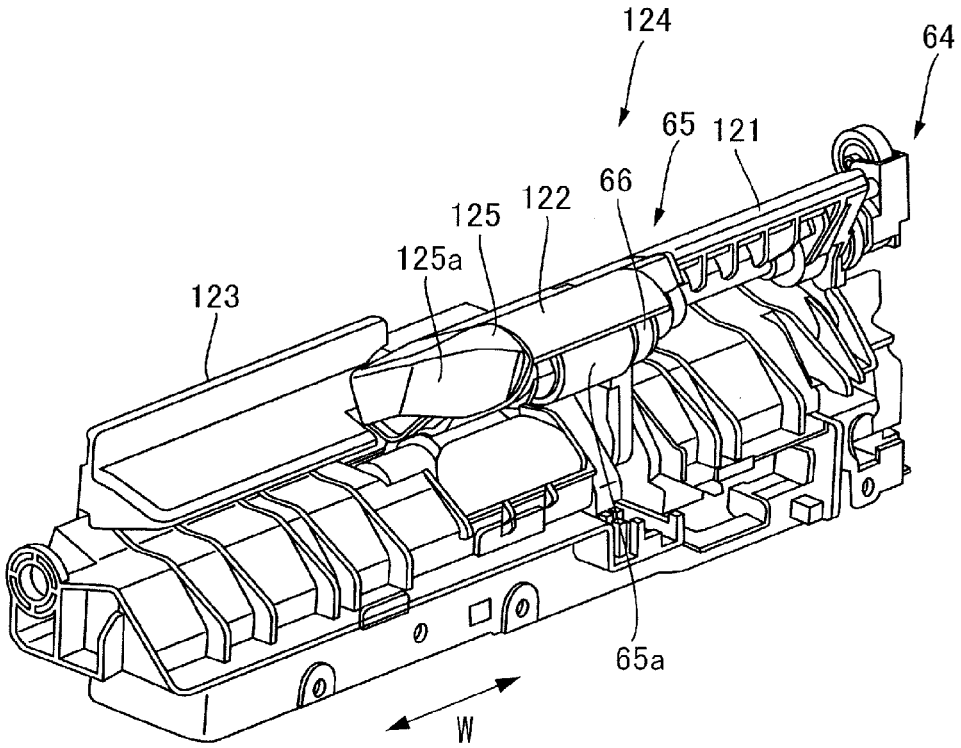
FIG. 4A is a perspective view illustrating a state in which a cover of the sheet feeding portion is connected with the pickup arm.
Figure 4B:
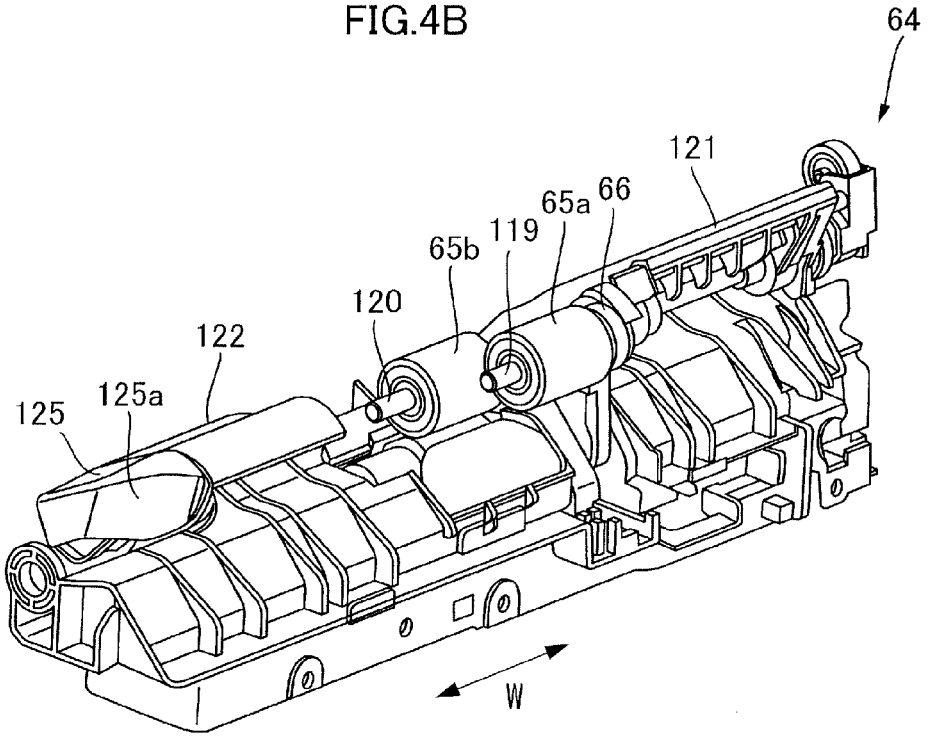
FIG. 4B is a perspective view illustrating a state in which the cover is uncovered from the pickup arm.

As shown in FIGS. 4A and 4B, the pickup arm 121, i.e., an arm, is provided along a width direction W from the pickup roller 65*a* side to an end portion side of the printer body 1A and turnably in a vertical direction around the feed roller shaft 120 as a fulcrum. Then, a pickup roller shaft (feed roller shaft) 119 is provided at an end on the pickup roller 65*a* side of the pickup arm 121 and supports the pickup roller 65*a*. That is, the pickup roller 65*a* is supported rotably by the pickup roller shaft 119. Then, the rotation of the feed roller shaft 120 is transmitted to the pickup roller shaft 119 through a gear train 66 (shown in FIGS. 4A and 4B) provided in linkage with the pickup arm 121 and rotates the pickup roller 65*a* in the sheet feeding direction. A dot chain straight line in a sheet conveying direction passing through a widthwise center of the pickup roller 65*a* is a conveyance center line C (conveyance reference line), i.e., a reference of the conveyance of the sheet. Therefore, the respective regulating members 111 and 112 regulate the side ends of the sheet by symmetrically moving in the width direction W from the center line C, so that the sheet is conveyed in a state in which a widthwise center of the sheet is aligned with the center line C.

The pickup arm 121 rotably and swingably supports the pickup roller 65*a*. The pickup arm 121 is biased downward centering on the feed roller shaft 120 by a bias spring not shown. The pickup arm 121 is arranged so as to swing in the vertical direction by a driving mechanism having a cam mechanism not shown and is normally held in a standby state at a standby position where the pickup roller 65*a* is held above the sheet as shown in FIG. 3A.

The pickup arm 121 is also dropped by the driving mechanism as shown in FIG. 3B in feeding the sheet. Thereby, the pickup roller 65*a* comes in contact with an uppermost sheet Sa of a sheet bundle Sb stacked on the manual feed tray 61. Subsequently, the pickup roller 65*a* rotates by the driving force of the driving portion 64 transmitted through the pickup roller shaft 119 and feeds the sheet Sa. It is noted that FIG. 3B illustrates a state in which the pickup arm 121 is dropped (to the lowest position) after feeding a last sheet S on the manual feed tray 61.

As shown in FIGS. 4A and 4B, the driving portion 64 is provided at one side of the width direction W of the sheet feeding portion 65. The driving portion 64 is composed of a driving motor not shown, a gear train transmitting the rotation of the driving motor to the feed roller shaft 120, and others. The driving portion 64 drives the pickup roller 65*a*, the feed roller 65*b* and the retard roller 65*c*.

The feed roller shaft 120 is supported by the manual feeding apparatus body 60*a* horizontally in the front and rear direction in a cantilever condition, and the pickup roller shaft 119 is also supported by the pickup arm 121 in a cantilever condition. Here, the pickup roller 65*a* and the feed roller 65*b* are removably mounted to the pickup roller shaft 119 and the feed roller shaft 120 respectively from free ends of the shafts. Then, the cover portion 122 for covering an upper side of the feed roller shaft 120, the pickup roller shaft 119, the pickup roller 65*a*, and the feed roller 65*b* is provided at the end on the pickup roller 65*a* side of the pickup arm 121.

One end of the cover portion 122 is removably connected to the pickup arm 121 and another end thereof is removably connected to the free ends of the pickup roller shaft 119 and the feed roller shaft 120. Then, as shown in FIG. 4A, the cover portion 122 is held by and covers above the pickup roller 65*a* and the feed roller 65*b*.

The cover portion 122 is also mounted to the pickup arm 121 by means of an engage portion not shown, e.g., snap-fit. Thereby, if the pickup arm 121 is turned to turn the pickup roller 65*a* in the vertical direction, the cover portion 122 provided rotatably on the feed roller shaft 120 coaxially with the pickup arm 121 turns in a body with the pickup arm 121. The holding portion 124 rotably bearing (holding) both ends of the pickup roller 65*a* is composed of the pickup arm 121 and the cover portion 122 turning in the vertical direction in a body with the pickup arm 121.

The cover portion 122 is also provided, at a widthwise front side thereof, with a guide plate 123 guiding the sheet S to the separating portion 69 and attached removably in the width direction W to the manual feeding apparatus 60*a*. The pickup roller 65*a* and the feed roller 65*b* can be removed from the free ends of the shafts 119 and 120 by removing the guide plate 123 and the cover portion 122 in replacing the rollers 65*a* and 65*b* as shown in FIG. 4B.

Next, an operation of manual feed using the manual feeding apparatus 60 constructed as described above will be described. In performing the manual feeding operation, firstly, the user opens the right cover 67 to move the manual feed tray 61 to the sheet stacking position as shown in FIG. 2. At this time, the pickup arm 121 is located at the standby position and the pickup roller 65*a* is located above the manual feed tray 61. Next, the user stacks a sheet S on the manual feed tray 61 that has been moved to the sheet stacking position. Then, the user moves the regulating members 111 and 112 corresponding to size of the sheet S to regulate positions of the side ends of the sheet S. It is noted that in a case of feeding an envelope, i.e., an exemplary sheet S, the user stacks the envelope in a direction in which a flap of the envelope abuts with one of the regulating members 111 and 112, e.g., the front side first regulating member 111 (see FIG. 10).

Then, when the user selects 'manual feed' from a manipulating portion of the color laser printer 1, a personal computer connected with the color laser printer 1 or the like, the pickup arm 121 drops from the standby position by the driving mechanism having the cam mechanism not shown. Then, the pickup roller 65*a* abuts against an upper surface of the sheet S stacked on the manual feed tray 61. Subsequently, the pickup roller 65*a* is rotated by the driving portion 64. Thereby, the uppermost sheet Sa of the sheet bundle Sb stacked on the manual feed tray 61 and whose side end positions are regulated by the regulating members 111 and 112 is conveyed to the separating portion 69 composed of the feed roller 65*b* and the retard roller 65*c*.

In the separating portion 69, the sheet S conveyed by the pickup roller 65*a* is separated at a nip portion between the feed roller 65*b*, driven by the driving portion 64 and rotating in the sheet conveying direction, and the retard roller 65*c*. Thereby, even if a plurality of sheets S is delivered by the pickup roller 65*a*, it is possible to deliver only the uppermost sheet Sa in a downstream direction.

Figure 5:
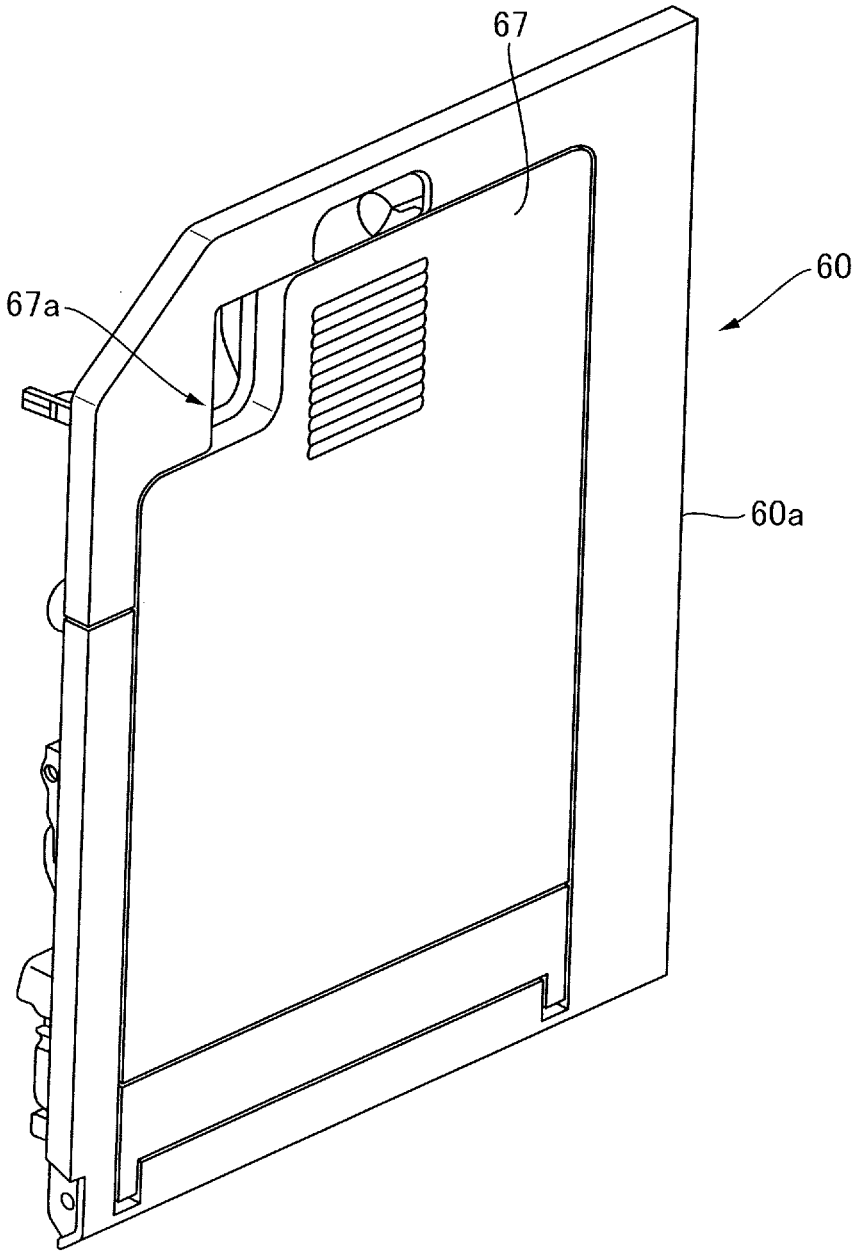
FIG. 5 is a perspective view illustrating a state in which a right cover provided in the manual feeding apparatus is closed.
Figure 6:
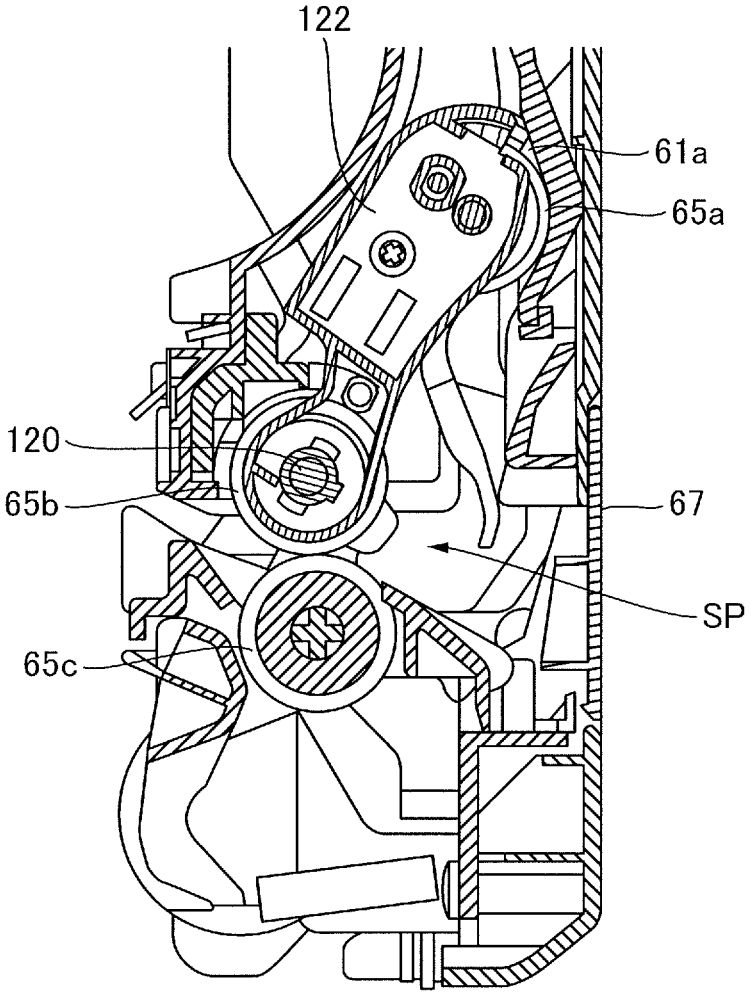
FIG. 6 illustrates a state of the manual feeding apparatus within the apparatus body when the right cover of the manual feeding apparatus is closed.
Figure 8A:
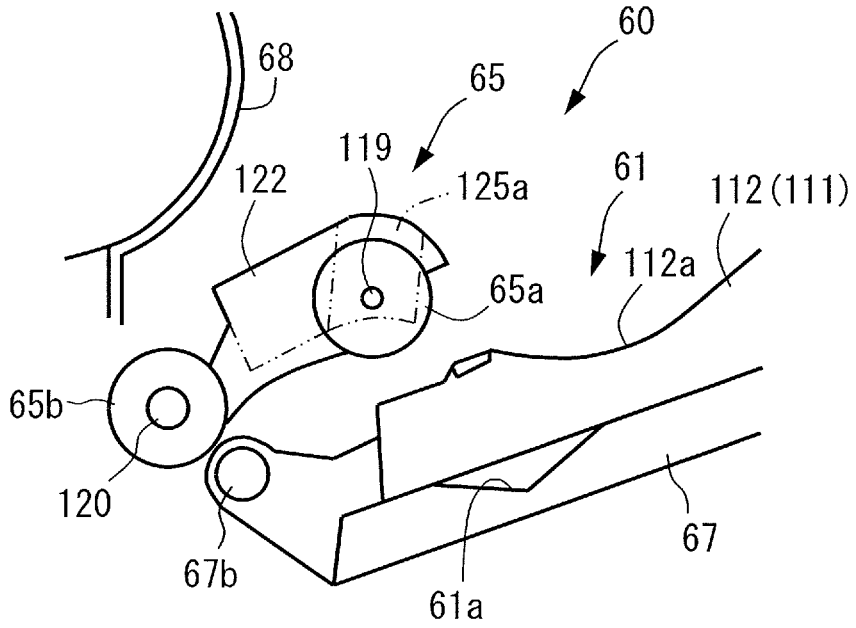
FIG. 8A is a schematic diagram illustrating a state in which a manual feed tray of the manual feeding apparatus is located at a sheet stacking position.
Figure 8B:
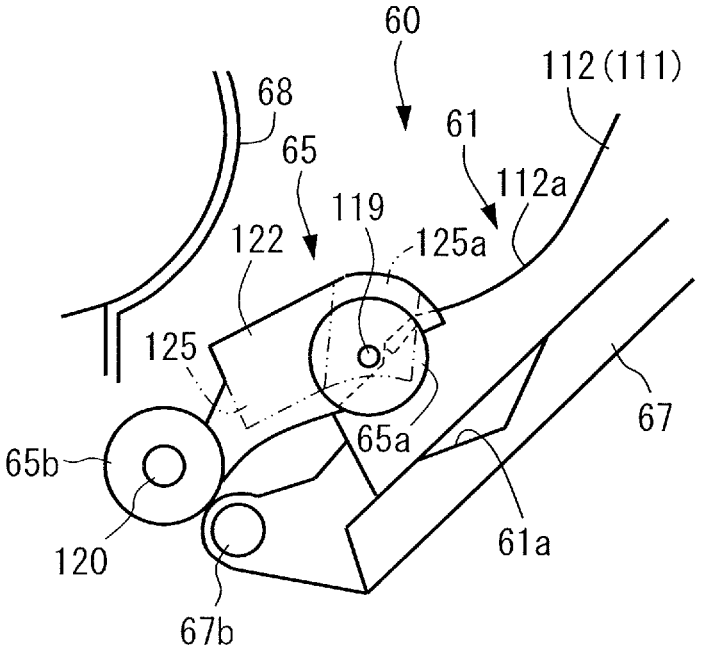
FIG. 8B is a schematic diagram illustrating a state in which an inclined surface abuts against a first regulating member when the manual feed tray of the manual feeding apparatus is closed.
Figure 9A:
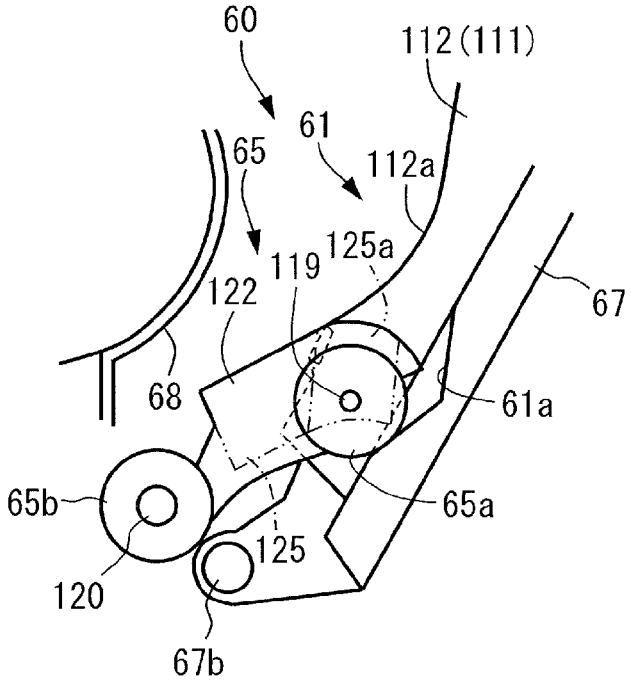
FIG. 9A is a schematic diagram illustrating a state in which a pickup roller abuts against the manual feed tray when the manual feed tray of the manual feeding apparatus is closed.
Figure 9B:
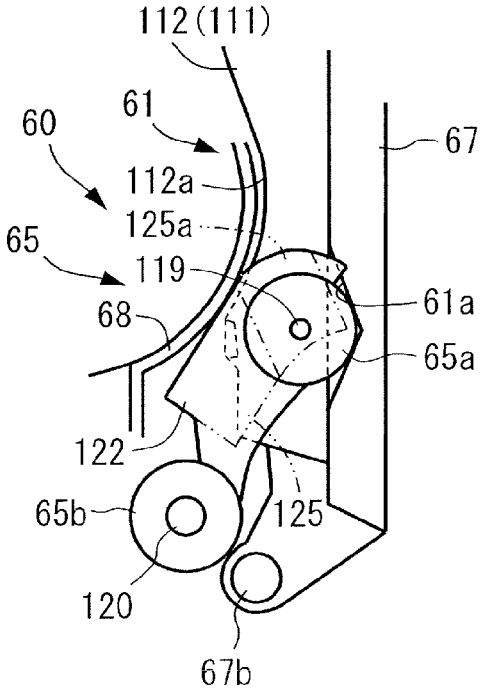
FIG. 9B is a schematic diagram illustrating a state in which the manual feed tray of the manual feeding apparatus is located at a storage position.

After when the manual feeding operation is finished or the manual feeding apparatus 60 is not in use, the manual feed tray 61 is stored within the manual feeding apparatus body 60*a* by closing the right cover 67 as shown in FIG. 5. Here, an operation of moving the manual feed tray 61 from the sheet stacking position shown in FIG. 8A to the storage position shown in FIG. 9B will be described. When the manual feed tray 61 is turned upward as shown in FIG. 8B, an inclined surface 125*a* provided on the cover portion 122 as described later abuts against the first regulating member 111 and moves the respective regulating members 111 and 112 toward outside in the width direction W. Then, as shown in FIG. 9A, the pickup roller 65*a* abuts against and is pressed by the manual feed tray 61 being closed and turns upward together with the pickup arm 121. FIGS. 9B and 6 illustrate the state when the right cover 67 is closed, and when the right cover 67 is closed, the manual feed tray 61 and the pickup roller 65*a* turn upward together with the right cover 67 and are stored within the manual feeding apparatus body 60*a*. In the case when the pickup roller 65*a* is stored, initially the manual feed tray 61 abuts against and raises the pickup roller 65*a* and from the way of the rise, the manual feed tray 61 abuts against the cover portion 122 and raises the pickup roller 65*a*. It is noted that the respective regulating members 111 and 112 are provided with circular arc dents 111*a* and 112*a* on the upper surfaces thereof so as to avoid the respective regulating members 111 and 112 from interfering with an internal structure 68 of the printer body 1A when the manual feed tray 61 is located at the storage position.

Here, as shown in FIG. 3B, the manual feed tray 61 is provided with the concave portion 61*a* and the pickup roller 65*a* enters the concave portion 61*a* when the manual feed tray 61 is stored. This arrangement makes it possible to reduce a storage space SP storing the manual feed tray 61 and others provided in the manual feeding apparatus body 60*a*. Thereby, it is possible to compact the manual feeding apparatus 60 and to reduce an outer shape (sizes in the right and left direction in FIG. 1) of the color laser printer 1.

It is noted that when the right cover 67 is closed, the right cover 67 (the manual feed tray 61) is held at the storage position because projections 113 provided on both sides in the width direction W of the manual feed tray 61 shown in FIG. 2 engage with engage holes not shown and provided in the manual feeding apparatus body 60*a*. Still further, when the manual feed tray 61 is stored or the manual feed tray 61 is located at the storage position, the pickup arm 121 stands by in a state biased in a right rotational direction in FIG. 6 centering on the feed roller shaft 120 by the bias spring not shown.

When the user tries to carry out the manual feeding operation, the user lays his/her hand on the concave portion 67*a* provided on the right cover 67 as shown in FIG. 5 to open the right cover 67. Then, the projection 113 is disengaged from the engage hole and the manual feed tray 61 is opened in a body with the right cover 67. It is noted that when the manual feed tray 61 is opened, the pickup arm 121 biased until then moves to the standby position shown in FIG. 3A by the bias force of the bias spring.

Lately, the demand for enabling the manual feeding apparatus 60 to feed various kinds of sheets is growing. Then, it is also required to be able to feed a sheet which is smaller than the conventional ones. However, lengths in an axial direction of the pickup roller 65*a*, the feed roller 65*b*, and the retard roller 65*c* are required to be more than predetermined sizes in order to deliver the sheet reliably and stably. Therefore, it is difficult to shorten the lengths in the axial direction of the respective rollers 65*a*, 65*b* and 65*c* corresponding to a width of a smallest size sheet.

Still further, it is necessary to provide the regulating members 111 and 112 as close to the separating portion 69 as possible in order to suppress a skew of the sheet S in separating and conveying the sheet S at the separating portion 69. Therefore, there is a possibility that the regulating members 111 and 112 located at positions regulating the smallest size sheet abut against the cover portion 122, the pickup arm 121 or the gear train 66 when the right cover 67 is closed after finishing to feed the smallest size sheet. An arrangement for solving this problem will be described below.

Figure 7:
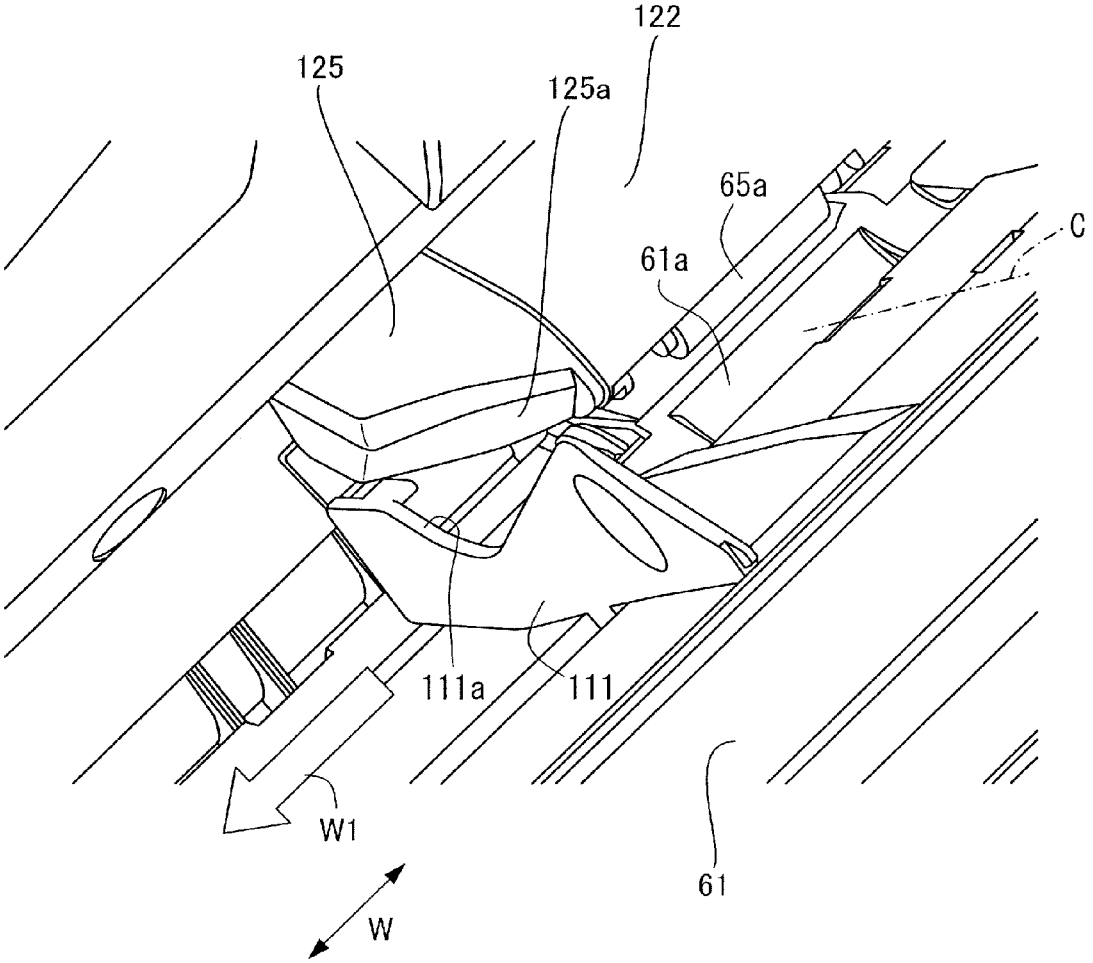
FIG. 7 is a perspective view illustrating a move of a regulating member when the right cover of the manual feeding apparatus is closed.

The cover portion 122 is provided with a guide portion 125 having the inclined surface 125*a* at an end thereof on the first regulating member 111 side, i.e., a side opposite from the pickup arm 121 with the pickup roller 65*a* therebetween in the width direction W as shown in FIGS. 4A, 4B and 7. A shape of the inclined surface 125*a* in a state in which the pickup arm 121 is located at the standby position will be described. That is, the inclined surface 125*a* is inclined such that a part thereof on the first regulating member 111 side in the width direction W is distant from the manual feed tray 61 more than a part thereof on the second regulating member 112 side. That is, the inclined surface 125*a* is inclined such that the further from the center line C, the longer a distance from the manual feed tray 61 becomes. The inclined surface 125*a* is inclined also in the sheet feeding direction such that a part thereof on an upstream side is distant from the manual feed tray 61 more than a part thereof on a downstream side. Still further, the inclined surface 125*a* is inclined in the width direction W such that the part thereof on the first regulating member 111 side is inclined downstream in the sheet feeding direction more than the part thereof on the second regulating member 112 side. That is, the inclined surface 125*a* is inclined such that the further from the center line C, the more the inclined surface is located downstream in the sheet conveying direction. In the present embodiment, the inclined surface 125*a* is inclined by about 45° with respect to the surface of the manual feed tray 61 in the sheet feeding direction. The inclined surface 125*a* is also provided within a range overlapping with the first regulating member 111 in the sheet feeding direction when the first and second regulating members 111 and 112 are set at the smallest sheet width.

That is, when the pickup arm 121 is located at the standby position, the inclined surface 125*a* is inclined such that the part thereof on the first regulating member 111 side in the width direction W is located downstream in the sheet feeding direction and above the part on the pickup roller 65*a* side (feed roller side) of the cover portion 122. When the regulating members 111 and 112 are located at the positions regulating side ends of a sheet stacked on the manual feed tray 61 and whose widthwise length is a predetermined length, the inclined surface 125*a* is located at a position facing the first regulating member 111. It is noted that in the present embodiment, the sheet of the predetermined length is a postcard whose widthwise length is shortest.

Thereby, when the manual feed tray 61 is closed together with the right cover 67 after finishing the manual feeding operation, the inclined surface 125*a* abuts against the first regulating member 111 as shown in FIGS. 7 and 8B. When the manual feed tray 61 is closed further after that as shown in FIG. 9A, the first regulating member 111 slides and moves in a direction of an arrow W1 in FIG. 7, i.e., a direction in which the widthwise distance between the regulating members 111 and 112 expands, along the inclination of the inclined surface 125*a*. Then, when the right cover 67 is closed as shown in FIG. 9B, the first regulating member 111 recedes to a position where the first regulating member 111 does not abut against (interfere with) the cover portion 122 in a direction in which the right cover 67 is closed. Still further, in linkage with the first regulating member 111, the second regulating member 112 also moves in a direction opposite from the moving direction of the first regulating member 111 and recedes to a position where the second regulating member 112 does not abut against (interfere with) the gear train 66 and the pickup arm 121 in the direction in which the right cover 67 is closed.

Thus, this arrangement in which the guide portion 125 is provided in the cover portion 122 and the inclined surface 125*a* abuts against the first regulating member 111 in closing the right cover 67 makes it possible to cause the first regulating member 111 to recede to the position where the first regulating member 111 does not interfere with the cover portion 122 in the direction in which the right cover 67 is closed. Still further, it is possible to cause the second regulating member 112 to recede to the position where the second regulating member 112 does not abut against (interfere with) the gear train 66 and the pickup arm 121 in the direction in which the right cover 67 is closed.

In a case when the widthwise distance between the regulating members 111 and 112 is made to a degree by which the regulating members 111 and 112 do not abut against the guide portion 125 when the manual feed tray 61 is moved to the storage position, the regulating members 111 and 112 do not interfere with the cover portion 122 and the pickup arm 121 in storing the manual feed tray 61. Due to that, the regulating members 111 and 112 are stored in a very state in which the manual feeding operation has been finished.

Figure 10:
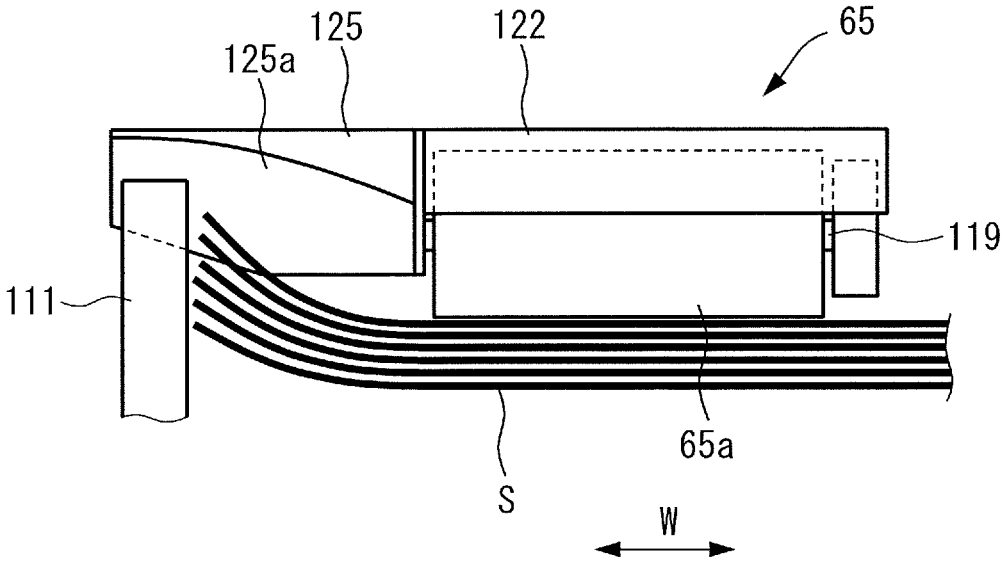
FIG. 10 is a schematic section view illustrating a state in which a curled sheet is fed by the manual feeding apparatus.

Still further, in a case when a curl has been generated at an end part of the sheet S stacked on the manual feed tray 61 as shown in FIG. 10, the sheet S is stacked by directing the curled part to the first regulating member 111 side. This arrangement makes it possible to improve flatness of the sheet S by pressing the curl of the sheet S when the sheet S is conveyed by the pickup roller 65*a* because the curled part comes into contact with the inclined surface 125*a* of the guide portion 125 and is guided downward.

Still further, in feeding an envelope, the envelope is stacked while directing a flap of the envelope toward the first regulating member 111. This arrangement makes it possible to press the flap of the envelope from being relieved when the envelope is conveyed by the pickup roller 65*a* because the flap comes into contact with the inclined surface 125*a* of the guide portion 125 and is guided downward. That is, the inclined surface 125*a* of the guide portion 125 constitutes a curl pressing portion pressing the curl of the sheet S and a relief regulating portion suppressing the relief of the flap of the envelope.

As described above, in the present embodiment, the guide portion 125 is provided with the inclined surface 125*a* that abuts against the first regulating member 111 movable in the width direction W following the upward turn of the manual feed tray 61. Then, the inclined surface 125*a* moves the first regulating member 111 in the direction in which the widthwise distance between the pair of regulating members 111 and 112 expands when the right cover 67 is closed, i.e., when the manual feed tray 61 is stored.

This arrangement makes it possible to move the regulating members 111 and 112 to the widthwise side positions of the cover portion 122 and the pickup arm 121 when the manual feed tray 61 is located at the storage position. As a result, the regulating members 111 and 112 do not interfere with the cover portion 122 and the pickup arm 121 in closing the manual feed tray 61, so that the manual feed tray 61 can be stored steadily within the manual feeding apparatus body 60*a* without enlarging the manual feeding apparatus body 60*a*.

It is noted that while the case in which the guide portion 125 is provided in the cover portion 122 composing the holding portion 124 has been described so far, the present invention is not limited to such a case. That is, the guide portion 125 may be provided at a position corresponding to the second regulating member 112 that has moved to a position for regulating a side end position of a smallest width size sheet of the pickup arm 121. Still further, the guide portion 125 may be provided at both of the cover portion 122 and the pickup arm 121. That is, the guide portion 125 may be formed at least one of the cover portion 122 and the pickup arm 121.

It is noted that while the present embodiment has been described based on the configuration in which the pickup roller 65*a* is stored within the apparatus body and the pickup roller 65*a* projects out of the apparatus body when the manual feed tray is opened, the present invention is not limited to such configuration. The present invention is applicable even to a case in which the pickup roller is stored always in the printer body (manual feeding apparatus body). The present invention is applicable even to such a case, to a system in which the pickup roller elevates/drops, and to a system in which the position of the pickup roller is fixed. Still further, while the case in which both of the regulating members 111 and 112 are movable in the width direction W has been described, the present invention is not limited to such a case and is applicable also to a case when at least one of the regulating members 111 and 112 is movable in the width direction W. Still further, while the case when the regulating members 111 and 112 move in linkage has been described so far, the present invention is applicable to a case in which the regulating members 111 and 112 move solely. In this case, the guide portion 125 may be provided on both widthwise side ends of the cover portion 122.

Still further, while the case when the guide portion 125 is provided in the sheet feeding portion 65 has been described in the present embodiment described above, the present invention is not limited to such a case. For instance, the guide portion 125 may be provided in the printer body 1A.

Still further, it is also possible to configure such that the guide portion 125 is provided on the first regulating member 111 side and the inclined surface 125*a* abuts against the sheet feeding portion or the apparatus body side member and guides the first regulating member 111 in the widthwise direction separating from the second regulating member 112 when the manual feed tray 61 moves from the sheet stacking position to the storage position.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-111489, filed May 29, 2014 and Japanese Patent Application No. 2015-102922, filed May 20, 2015 which are hereby incorporated by reference herein in their entirety.

What is claimed is:

1. A sheet feeding apparatus, comprising:

an apparatus body;

a sheet storing portion supported by the apparatus body turnably in a vertical direction and movable to a storage position in which the sheet storing portion is stored within the apparatus body and to a sheet stacking position in which a sheet is stacked;

a first regulating member provided in the sheet storing portion and movable in a width direction orthogonal to a sheet feeding direction;

a second regulating member provided in the sheet storing portion to face the first regulating member widthwise and regulating widthwise side end positions of the sheet stacked on the sheet storing portion together with the first regulating member;

a feed portion provided in the apparatus body and feeding the sheet stacked on the sheet storing portion when the sheet storing portion is in the sheet stacking position; and a guide portion provided on at least one of the apparatus body and the first regulating member and having an inclined surface that abuts against another member of the apparatus body and the first regulating member to guide the first regulating member in a direction separating widthwise from the second regulating member when the sheet storing portion moves from the sheet stacking position to the storage position.

2. The sheet feeding apparatus according to claim 1, wherein the inclined surface is provided on the apparatus body side and abuts against the first regulating member to move the first regulating member in the direction separating from the second regulating member when the sheet storing portion is moved from the sheet stacking position to the storage position.

3. The sheet feeding apparatus according to claim 1, wherein the inclined surface inclines such that a part thereof on the first regulating member side inclines in a direction distant from the sheet storing portion more than a part thereof on the second regulating member side.

4. The sheet feeding apparatus according to claim 3, wherein the inclined surface inclines such that an upstream part thereof in the sheet feeding direction is inclined in a direction distant from the sheet storing portion more than a downstream part thereof.

5. The sheet feeding apparatus according to claim 1, wherein the inclined surface is inclined such that the widthwise part thereof on the first regulating member side is located downstream in the sheet feeding direction more than the part thereof on the second regulating member side.

6. The sheet feeding apparatus according to claim 1, wherein the inclined surface is provided within a range overlapping in the sheet feeding direction with the first regulating member when the first and second regulating members are set at positions corresponding to a smallest sheet width.

7. The sheet feeding apparatus according to claim 1, wherein the feed portion includes:

a feed roller feeding the sheet stacked on the sheet storing portion;

an arm rotably and swingably supporting the feed roller; and a cover portion covering the feed roller from above, wherein the guide portion is provided on at least at one of the arm and the cover portion.

8. The sheet feeding apparatus according to claim 7, wherein the guide portion is provided at the cover portion.

9. The sheet feeding apparatus according to claim 8, wherein the feed roller is cantilever-supported by the arm, and the guide portion is disposed on a side opposite from the arm with the feed roller therebetween in the width direction.

10. The sheet feeding apparatus according to claim 1, further comprising an interlock mechanism interlocking the first and second regulating members such that they move in directions opposite from each other in the width direction.

11. An image forming apparatus, comprising:

an image forming portion forming an image on a sheet; and a sheet feeding apparatus feeding the sheet to the image forming portion, the sheet feeding apparatus comprising:

an apparatus body;

a sheet storing portion supported by the apparatus body turnably in a vertical direction and movable to a storage position in which the sheet storing portion is stored within the apparatus body and to a sheet stacking position in which a sheet is stacked;

a first regulating member provided in the sheet storing portion and movable in a width direction orthogonal to a sheet feeding direction;

a second regulating member provided in the sheet storing portion to face the first regulating member widthwise and regulating widthwise side end positions of the sheet stacked on the sheet storing portion together with the first regulating member;

a feed portion provided in the apparatus body and feeding the sheet stacked on the sheet storing portion when the sheet storing portion is in the sheet stacking position; and a guide portion provided on at least one of the apparatus body and the first regulating member and having an inclined surface that abuts against another member of the apparatus body and the first regulating member to guide the first regulating member in a direction separating widthwise from the second regulating member when the sheet storing portion moves from the sheet stacking position to the storage position.

12. A sheet feeding apparatus, comprising:

an apparatus body;

a sheet storing portion supported by the apparatus body turnably in a vertical direction and movable to a storage position in which the sheet storing portion is stored in the apparatus body and to a sheet stacking position in which a sheet is stacked;

a pair of regulating members provided such that at least one of them is movable in a width direction orthogonal to a sheet feeding direction and regulating widthwise side end positions of the stacked sheet;

a feed roller feeding the sheet stacked on the sheet storing portion when the sheet storing portion is in the sheet stacking position; and a holding portion holding the feed roller, the holding portion having an inclined surface abutting against the regulating member located at a position regulating a side end of a sheet stacked on the sheet storing portion and whose widthwise length is shorter than a predetermined length when the sheet storing portion is moved to the storage position and moving the regulating member to a side position of the holding portion when the sheet storing portion is located at the storage position.

13. The sheet feeding apparatus according to claim 12, wherein the holding portion includes an arm turnably provided and supporting a feed roller shaft around which the feed roller is provided by a cantilever shaft and a cover portion covering the feed roller, the cover portion having the inclined surface inclined such that a part thereof on a widthwise end is located downstream in a sheet feeding direction more than a part thereof on a feed roller side in a state in which the sheet storing portion is located at the sheet stacking position, and the inclined surface is disposed at a position facing the regulating member located at a position regulating a side end of a sheet stacked on the sheet storing portion and whose widthwise length is shorter than a predetermined length.

14. The sheet feeding apparatus according to claim 12, further comprising an interlock mechanism moving one regulating member in a direction opposite to a moving direction of the other regulating member when one of the pair of regulating members moves.

15. The sheet feeding apparatus according to claim 13, wherein the cover portion is removably mounted to the arm and the feed roller can be removed out of the feed roller shaft in a state in which the cover portion is dismounted from the arm.

16. The sheet feeding apparatus according to claim 12, further comprising a cover provided in the apparatus body openably in the vertical direction, the cover having the sheet storing portion therein.

17. The sheet feeding apparatus according to claim 12, wherein the inclined surface constitutes a curl pressing portion pressing a curl of a sheet to be conveyed by the feed roller when the sheet storing portion is moved to the sheet stacking position.

18. The sheet feeding apparatus according to claim 12, wherein the inclined surface constitutes a relief regulating portion suppressing relief of a flap of an envelope to be conveyed by the feed roller when the sheet storing portion is moved to the sheet stacking position.

19. An image forming apparatus, comprising:

an image forming portion forming an image on a sheet; and a sheet feeding apparatus feeding the sheet to the image forming portion, the sheet feeding apparatus comprising:

an apparatus body;

a sheet storing portion supported by the apparatus body turnably in a vertical direction and movable to a storage position in which the sheet storing portion is stored in the apparatus body and to a sheet stacking position in which a sheet is stacked;

a pair of regulating members provided such that at least one of them is movable in a width direction orthogonal to a sheet feeding direction and regulating widthwise side end position of the stacked sheet;

a feed roller feeding the sheet stacked on the sheet storing portion when the sheet storing portion is in the sheet stacking position; and a holding portion holding the feed roller, the holding portion having an inclined surface abutting against the regulating member located at a position regulating a side end of a sheet stacked on the sheet storing portion and whose widthwise length is shorter than a predetermined length when the sheet storing portion is moved to the storage position and moving the regulating member to a side position of the holding portion when the sheet storing portion is located at the storage position.

20. The sheet feeding apparatus according to claim 7, wherein the cover portion is removably attached to the arm.

21. The sheet feeding apparatus according to claim 1, wherein the second regulating members overlaps the feed portion as viewed in the width direction in a case that the sheet storing portion is positioned at the storage position.

22. The sheet feeding apparatus according to claim 13, wherein the cover portion is removably attached to the arm.

23. The sheet feeding apparatus according to claim 12, wherein at least one of a pair of regulating members overlaps with the feed roller as viewed in the width direction when the sheet storing portion is positioned at the storage position.

* * * * *